US006210038B1

(12) United States Patent
Tomic

(10) Patent No.: US 6,210,038 B1
(45) **Date of Patent: *Apr. 3, 2001**

(54) CLOSURE ARRANGEMENT HAVING A PEELABLE SEAL INDICATOR

(75) Inventor: Mladomir Tomic, Appleton, WI (US)

(73) Assignee: Reynolds Consumer Products, Inc., Richmond, VA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/185,242

(22) Filed: Nov. 3, 1998

(51) Int. Cl.[7] ..... B65D 33/16
(52) U.S. Cl. ..... 383/210; 383/5; 383/61
(58) Field of Search ..... 383/5, 210, 61, 383/63

(56) References Cited

U.S. PATENT DOCUMENTS 3,616,898 * 11/1971 Massie ..... 383/210
3,938,659 * 2/1976 Wardwell ..... 383/210
4,488,647 * 12/1984 Davis ..... 383/210
4,705,174 * 11/1987 Goglio ..... 383/210
4,838,708 * 6/1989 Holcomb et al. ..... 383/5
4,937,040 * 6/1990 Holcomb et al. ..... 383/5
4,998,666 * 3/1991 Ewan ..... 383/5
5,060,848 * 10/1991 Ewan ..... 383/5
5,242,516 * 9/1993 Custer et al. ..... 383/63
5,366,294 * 11/1994 Wirth et al. ..... 383/61
5,492,411 * 2/1996 May ..... 383/61
5,747,126 * 5/1998 Erden ..... 383/61
5,887,980 * 3/1999 May ..... 383/210
5,893,645 * 4/1999 May ..... 383/210
5,904,425 * 5/1999 May ..... 383/61

* cited by examiner

*Primary Examiner*—Stephen P. Garbe

(57) ABSTRACT

A peelable seal includes two opposing ribbed layers. The ribs are colored so they are visible when the hermetic seal has not yet been activated. When the hermetic seal is activated, the two opposing ribbed layers fuse together. This fusion destroys the ribs and results in one fused layer. The entire resulting layer is then colored. This provides an indication to the manufacturer that the hermetic seal has been achieved and provides an indication to the consumer that the hermetic seal is intact.

13 Claims, 3 Drawing Sheets

CLOSURE ARRANGEMENT HAVING A PEELABLE SEAL INDICATOR

FIELD OF THE INVENTION

The present invention generally relates to closure arrangements for polymeric packages and, in particular, to a closure arrangement having a peelable seal.

BACKGROUND

In many consumer packaging applications, it is important to prevent air or water from passing out of or into a package containing certain products. This is particularly true with respect to meat packages, cheese packages, and the like, for which the contained product must be kept in a constant environment to prevent spoilage. In order to preserve the product contained within such a package, the periphery of the package must be hermetically sealed. Hermetic seals can be provided by both permanent seals and temporary seals, known as peelable seals. Peelable seals are usable to provide a hermetic seal and, at the same time, provide a consumer with access to the contents of the package. A consumer breaks a peelable seal of a package by first grabbing onto opposing film faces to which peelable seal materials are adhered and then pulling the film faces apart.

A common method of packaging foods, such as sliced luncheon meats and the like, is by use of horizontal form, fill, and seal procedures. These procedures involve shaping a portion of film ("form"), placing the food article inside or upon the formed film portion ("fill"), completing the closure of the film portion around the food article and "sealing" open edges to complete the packaging process.

In some implementations, one sealing station is used to seal all the edges of a package and, at the same time, make a peelable seal from a strip of peelable materials. The sealing station has a set of seal bars, protruding from a sealing head, that press the package edges in the peelable strip against a resilient backing, such as rubber, to form both the permanent edge seals and the peelable seal. The strength of the seals is determined by the temperature, pressure, size of the seals, and dwell time of the seal bars.

Many packaging applications use resealable containers to store various types of articles and materials. These packages may be used to store and ship food products, non-food consumer goods, printed matter, correspondence, medical supplies, waste materials, and many other articles.

Resealable packages are convenient in that they can be closed and resealed after the initial opening to preserve the enclosed contents. The need to locate a storage container for the unused portion of the products in the package is thus avoided. As such, providing products in resealable packages appreciably enhances the marketability of those products.

The "sealing" stage of the form, fill, and seal procedure often involves using a resealable closure mechanism. The resealable closure mechanism and peelable seal are often produced as separate items fiom the package and are attached to and made integral with the package at a later point in the manufacturing process by a heat and pressure sealing process. Each separate closure profile includes a base strip and an interlocking member. In some conventional implementations, the closure profiles are formed by two separate extrusions or through two separate openings of a common extrusion die. One closure profile may have a rib or male member and the other, a mating groove or female member. The male or female member extends from the front face of the base strip. The rib and groove form a pressure-fastenable and releasable closure mechanism. The back side, or sometimes an extended portion of the front face of the base strip, is sealed to the package film so that the closure mechanism is disposed between the package walls adjacent to the openable side of the package. In some implementations, the packages are made of polymeric materials, since these materials inhibit the migration of air and water from and into the package. The packages can be either flexible or rigid.

To provide a peelable seal on a package with a resealable closure mechanism, the package typically uses permanent seals at its side edges and bottom edge and a peelable seal above or below the resealable closure mechanism at the mouth end of the package. In addition, the peelable seal may be arranged on either the flange/base portions of the closure mechanism or on the packaging film adjacent to the flange portions.

There are a couple of common implementations for forming peelable seals on resealable packages having a top and bottom film. One implementation adheres a multi-layered film to each of the opposing inner surfaces of the packaging film along the length of the mouth end of the package. This results in a first multi-layered film on the inner surface of the top film and a second multi-layered film on the inner surface of the bottom film. A peelable seal is formed by heat-sealing the first and second multi-layered films to one another. When a consumer breaks the peelable seal, one or more layers of the second multi-layered film will disengage from the other layers of the second multi-layered film and remain adhered to the first multi-layered film. As a result, the first multi-layered film will include at least one additional layer when the peelable seal is broken. The above layer disengagement upon breaking the peelable seal is accomplished by using film layers composed of different polymeric materials and by exploiting the varying bond strengths between the layers.

Another implementation adheres a layer of film to each of the opposing inner surfaces of the packaging film and introduces contaminants to one or both of the film layers. When the peelable seal is formed by heat-sealing the layers to one another, the bond between them is weak due to the surface contamination. Breaking the peelable seal detaches the layers from one another.

In order to preserve the product contained within a package, it is important that the peelable seal provides a hermetic seal. Peelable seals are highly susceptible to small variations that might occur during manufacture; ie., the peelable seals have low manufacturing tolerances. Given these manufacturing variations, it is possible for a peelable seal to not be hermetically sealed. In the current manufacturing process, it is difficult for the manufacturer to know which peelable seals are hermetically sealed and which are not. Furthermore, one purpose of the peelable seal is to provide a tamper resistant package to the consumer. With current peelable seals, it is difficult for the consumer to detect if the package has been tampered.

SUMMARY OF THE INVENTION

In one aspect of the present invention, one example embodiment involves a closure arrangement for use with a polymeric package. The closure arrangement includes a first and second base strip. Each base strip has an inner and an outer surface. The outer surfaces are adapted for attachment to the polymeric package. The closure arrangement further includes a peelable seal. The peelable seal has a first and second layer for attachment to the first and second base strips. The peelable seal further has a third layer attached to the first layer, and a fourth layer attached to the second layer. The third and fourth layers have colored ribs. These ribs indicate to the manufacturer that a hermetic seal has not been achieved.

In another embodiment of the present invention, a closure arrangement includes a first and second base strip. Each base strip has an inner and an outer surface. The outer surfaces are adapted for attachment to the polymeric package. The closure arrangement further includes a peelable seal. The peelable seal has a first and second layer for attachment to the first and second base strips. The first and second layers also have a pattern printed on the them. These patterns indicate to the manufacturer that a hermetic seal has not yet been achieved.

According to another aspect of the present invention, a method of manufacturing a polymeric package is provided. The method includes placing a first film panel adjacent to a second film panel, sealing tree edges of the first film panel to three corresponding edges of the second film panel, placing a peelable seal between a fourth edge of the first film panel and a corresponding fourth edge of the second film panel, and heat sealing the peelable seal to both the first film panel and the second film panel while simultaneously fusing the peelable seal.

The above summary of the present invention is not intended to describe each illustrated embodiment or every implementation of the present invention. The figures and the detailed description that follow more particularly exemplify these embodiments.

BRIEF DESCRIPTION OF THE DRAWINGS

The invention may be more completely understood in consideration of the detailed description of various embodiments of the invention that follows in connection with the accompanying drawings in which.

Figure 1:
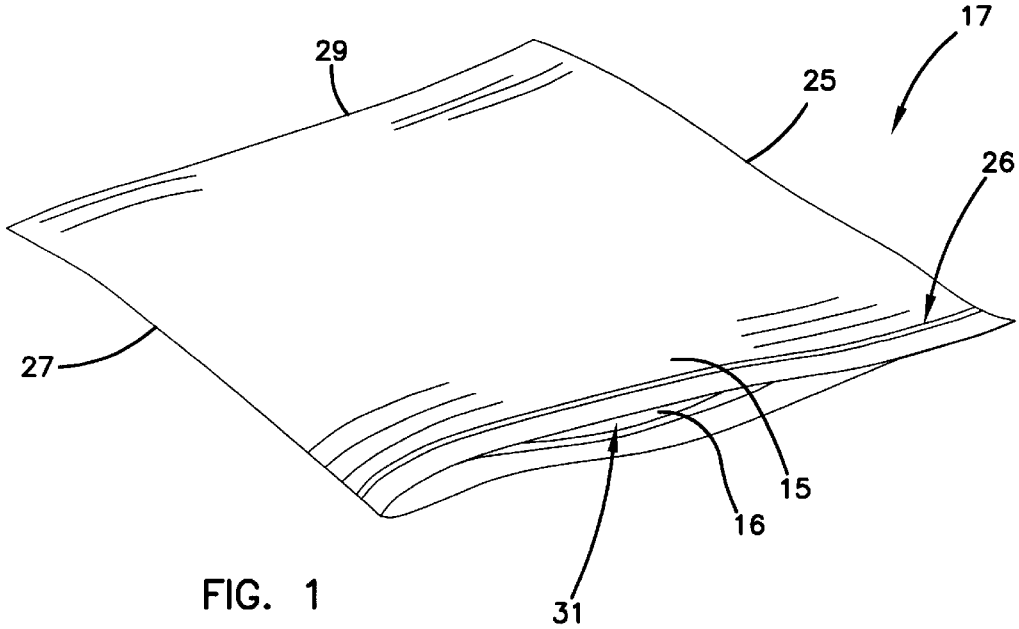
FIG. 1 is a perspective view of a flexible, resealable package according to an example embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

The present invention is believed to be applicable to a variety of packaging arrangements. The invention has been found to be particularly advantageous for use in sealing mechanisms for polymeric packages. An appreciation of various aspects of the invention is best gained through a discussion of an application example for such a packaging arrangement.

Figure 2:
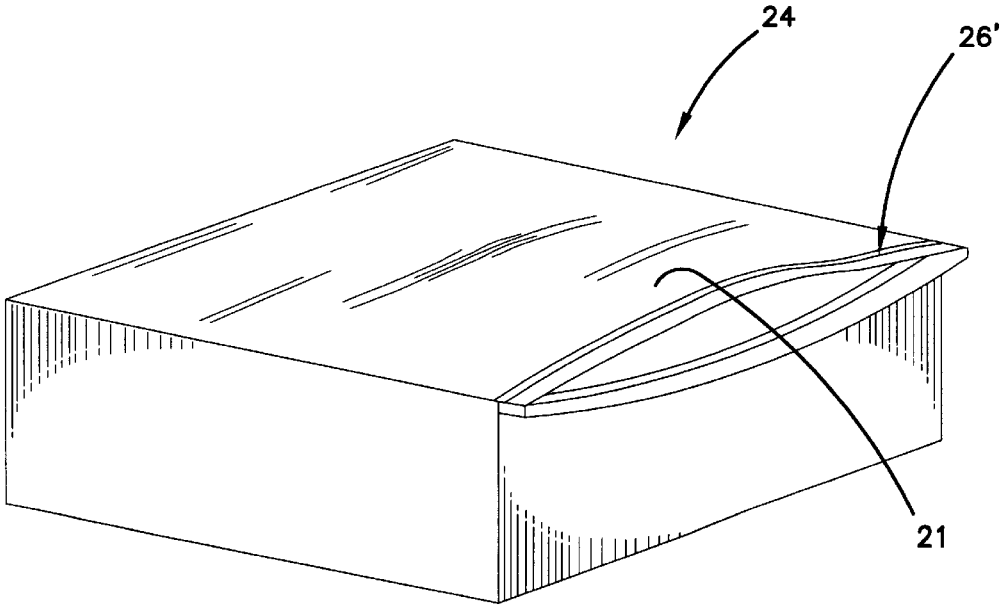
FIG. 2 is a perspective view of a rigid, resealable package according to an example embodiment of the present invention.

According to an example embodiment of the present invention, a package includes a peelable seal indicator to allow the manufacturer to inspect for a hermetic or airtight seal and to provide the consumer a way of checking for a tamper resistant package. FIGS. 1 and 2 illustrate example types of packages 17, 24 that benefit from use of such peelable seal indicators.

FIG. 1 illustrates an example packaging arrangement in the form of a resealable, flexible package 17 having a zipper-type closure mechanism 26 constructed in accordance with the present invention. The flexible package 17 includes first and second opposed panel sections 15, 16 made from a flexible, polymeric film. For some manufacturing applications, the first and second panel sections 15, 16 are heat-sealed together along two edges and meet at a fold line in order to form a three-edged containment section for a product within the interior of the package 17. The fold line comprises the bottom edge 29. Alternatively, two separate panel sections 15, 16 of polymeric film may be used and heat-sealed together along the two edges 25, 27 and at the bottom 29. Access is provided to the interior of the package 17 through a mouth 31. In other implementations, the package 17 includes tear strings and/or notches at the mouth 31 to assist with opening the package 17.

FIG. 2 is a perspective view depicting a rigid resealable package 24. The rigid resealable package 24 has the same basic features as the flexible resealable package 17 of FIG. 1. The package 24, however, has one flexible top side 21. The remaining five sides are rigid or a combination of rigid and flexible.

The flexible package 17 and the package 24 may be used to hold a variety of products. Such products may be a variety of edible food products such as cheese, meat, crackers, sugar, powdered sugar, flour, salt, and baking soda, or non-food products such as laundry detergent, sand, medical supplies, and other products. Resealable packages are convenient in that they can be closed and resealed after the initial opening to preserve the enclosed contents. The need to locate a storage container for the unused portion of the products in the package is thus avoided. As such, providing products in resealable packages appreciably enhances the marketability of those products.

A resealable closure mechanism 26 is illustrated in FIG. 1 at the opening of the flexible package 17. A similar closure mechanism 26' is illustrated in FIG. 2. Each closure mechanism 26 or 26' extends the width of the package 17 or 24. In the particular embodiment illustrated in FIG. 3, the resealable closure mechanism 26 of FIG. 1 is shown in the specific form of a zipper-type mechanism.

Figure 3:
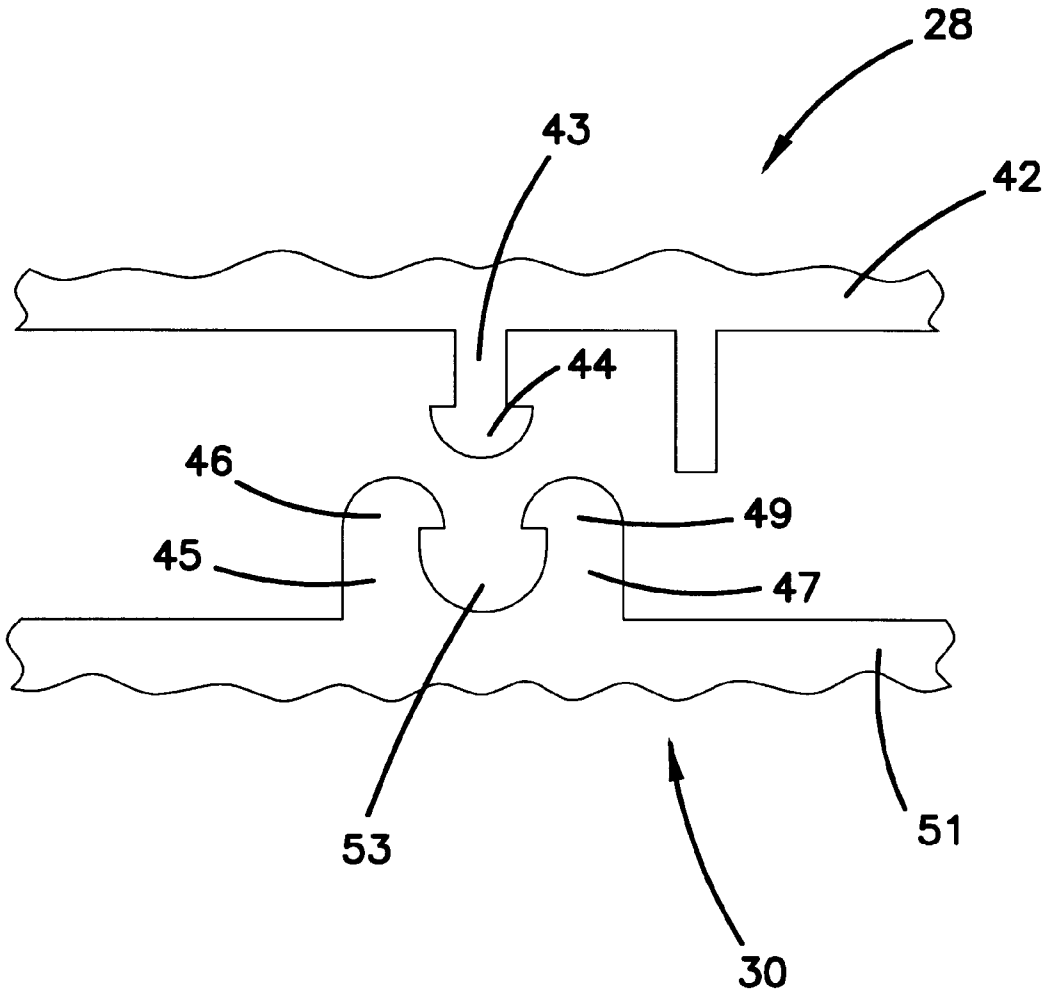
FIG. 3 is a fragmented, cross-sectional view of a particular type of resealable closure mechanism, according to an example embodiment of the present invention, showing its male and female closure profiles.

Attention is directed to FIG. 3. The resealable closure mechanism 26 is shown in expanded form to include an elongated male closure profile 28 and an elongated female closure profile 30. The male closure profile 28 is comprised of a base strip 42, a rib or male interlocking closure member 44 at a free end, and a stem 43. The male interlocking member 44 is generally T-shaped. In one embodiment, the base strip 42 is attached to the first panel section 15 of the flexible package 17 by a heat and pressure seal process.

The female closure profile 30 includes one of many types of interlocking structures for interlocking with the male closure profile 28. This particular example of a locking structure of the female closure profile 30 includes first and second legs 45, 47. The first and second legs 45, 47 have a J-shaped cross section and interlocking closure members 46, 49. Interlocking members 46, 49 mechanically engage the interlocking member 44 of the male profile 28 in order to reseal the package 17 at the mouth 31. The first and second legs 45, 47 are joined by a common base strip 51 that is attached to the second panel section 16 by, for example, a conventional heat and pressure seal process.

A mating groove 53 functions to contain the interlocking member 44 of the male closure profile 28. When pressure is applied to the closure profiles 28, 30, they engage and form a resealable closure mechanism 26. Pulling the male closure profile 28 and female closure profile 30 away from each other causes the two profiles to disengage, opening the package.

In some applications, the profiles are formed by two separate extrusions or through two separate openings of a common extrusion. Typically, the resealable closure mechanism 26 is made of a flexible polymeric material. Generally, the closure profiles 28, 30 are manufactured separately from the package and are subsequently attached to the package, such as the flexible resealable package 17 of FIG. 1 or the rigid resealable package 24 of FIG. 2, using a conventional heat and pressure seal process.

Figure 4:
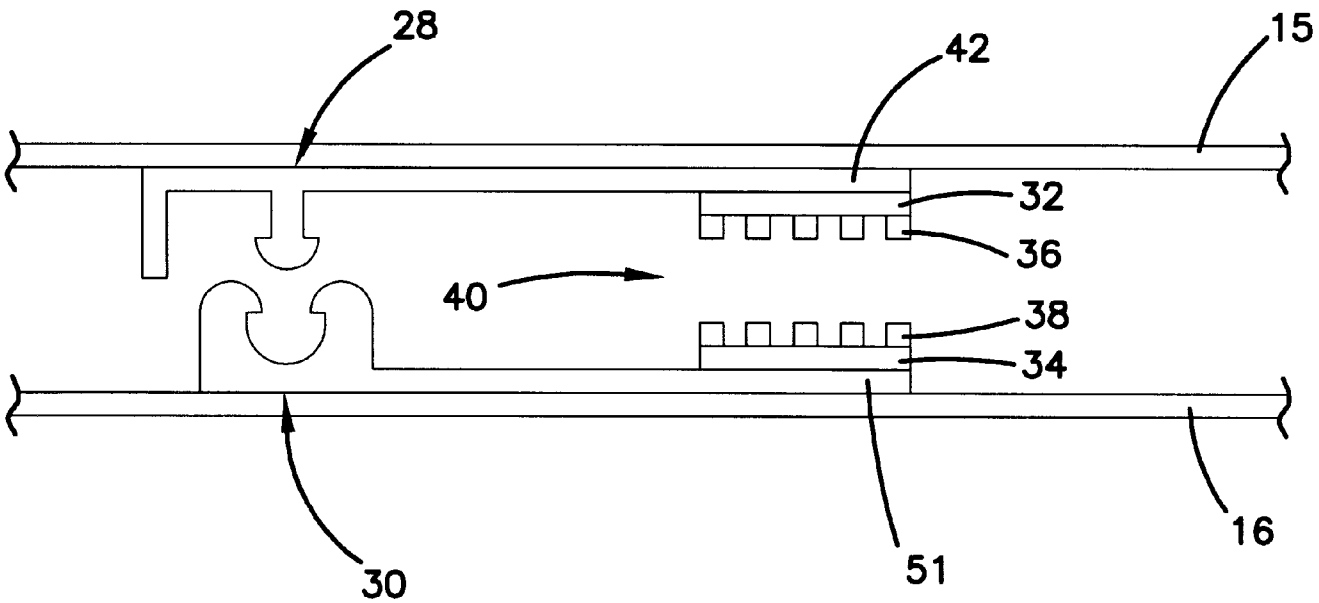
FIG. 4 is a fragmented, cross-sectional, somewhat schematic view of a resealable closure mechanism with a peelable seal, also according to an example embodiment of the present invention.

FIG. 4 illustrates a cross-sectional view of an example peelable seal according to an embodiment of the present invention. The elongated male closure profile 28 of FIG. 3 is shown attached to the first package film 15 of FIG. 1. The elongated female closure profile 30 of FIG. 3 is also shown attached to the second package film 16 of FIG. 1. The male closure profile 28 includes corresponding base strip 42, and the female closure profile 30 includes corresponding base strip 51.

In FIG. 4, the peelable seal 40 includes a first peelable layer 32 and a second peelable layer 34. The first peelable layer 32 is bonded to the base strip 42 of the male closure profile 28. The second peelable layer 34 is likewise bonded to the base strip 51 of the female closure profile 30. The peelable seal 40 further includes a third peelable layer 36 and a fourth peelable layer 38. The third peelable layer 36 is bonded to the first peelable layer 32. The fourth peelable layer 38 is bonded to the second peelable layer 34. In the example embodiment shown in FIG. 4, the third and fourth peelable layers 36, 38 have ribs. In another example embodiment, only one of the third and fourth peelable layers 36,38 has ribs, and the other peelable layer is a flat surface in a variation of the preceding, either or both layer 32 and layer 34 may be omitted.

In one example embodiment, the closure arrangement illustrated in FIG. 4 is manufactured using conventional extrusion and heat sealing techniques. In particular, the closure profiles 28, 30 and the peelable layers 32,34, 36, 38 are co-extruded through a die plate fed by a plurality of extruders. These extruders carry the different molten materials for forming the closure profiles 28, 30 and the peelable layers 32, 34, 36, 38. As is well-known in the art, the die plate includes input ports, output ports, and channels connecting these input ports to output ports. The extruders feed the different molten materials to different input ports, and the channels are designed to configure the molten materials into the shapes of the closure profiles 28, 30 and peelable layers 32, 34, 36, 38. In this process, the first peelable layer 32 is bonded to the base strip 42, and the third peelable layer 36 is bonded to the first peelable layer 32. Furthermore, the second peelable layer 34 is bonded to the base strip 51, and the fourth peelable layer 38 is bonded to the second peelable layer 34.

Generally, the closure profiles 28, 30 and peelable layers 32, 34, 36, 38 are extruded from a polymeric resin such as polyethylene, polybutylene or polypropylene. In one example embodiment, the peelable layers 32, 34, 36, 38 are extruded from a polymeric material with a lower bond strength than the package films 15, 16 or the closure profiles 28, 30. In another example embodiment, the peelable layers 32, 34, 36, 38 are extruded from the same polymeric material but are weakened by adding contaminants to the resin. This causes the peelable layers 32, 34, 36, 38 to have a lower bond strength than the package films 15, 16 or the closure profiles 28, 30.

The resins for the third and fourth peelable layers 36, 38 are pigmented with a color such that after manufacturing, the ribs are easily seen. In one example embodiment, the third and fourth peelable layers 36, 38 are pigmented the same color. In another example embodiment, the third peelable layer 36 is pigmented one color while the fourth peelable layer 38 is pigmented a separate color. For example, the third peelable layer 36 is colored blue, and the fourth peelable layer 38 is colored yellow.

After manufacturing, the closure profiles 28, 30 are interlocked, and the third peelable layer 36 is located opposite and adjacent to the fourth peelable layer 38. The colored ribs of the third and fourth peelable layers 36, 38 are readily visible to the manufacturer, indicating a hermetic seal has not yet been achieved. The spacing of ribs between sides shows that a seal has not been made. The closure arrangement is then attached to the package films 15, 16 by a conventional heat and pressure seal process. This process causes the package films 15, 16 to heat-fuse with the base strips 42, 51. This process further causes the third peelable layer 36 to heat-fuse with the fourth peelable layer 38 such that one fused layer results providing the hermetic seal.

In one example embodiment, the third and fourth peelable layers 36, 38 are no longer visible, and the entire resulting layer, resulting from the fusion of the third and fourth peelable layers 36, 38, is colored, leaving a wide band of color rather than individual ribs of color. The lack of colored ribs and the presence of the wide band of color indicates to the manufacturer that a hermetic seal has been achieved. It also indicates to the consumer that the hermetic seal is intact.

In another example embodiment, where the third peelable layer 36 is one color (i.e. blue) and the fourth peelable layer 38 is a separate color (i.e. yellow), the resulting layer has a wide band of a third color (i.e. green). The presence of this third color indicates to the manufacturer the hermetic seal has been achieved. It also indicates to the consumer that the hermetic seal is intact.

In yet another embodiment, the peelable seal consists of only a first and second peelable layer. The first and second peelable layers are printed with a pattern that, after manufacturing, is visible to the manufacturer indicating the hermetic seal has not yet been achieved. Upon heat-fusing the closure arrangement to the package films, the fusion of the first and second peelable layer causes the pattern to be destroyed. This provides an indication to the manufacturer that the hermetic seal has been achieved and an indication to the consumer that the hermetic seal is intact.

In yet another embodiment, the peelable seal exists without the interlocking closure mechanisms. In this embodiment, the peelable seal is co-extruded with the base strips and then heat-fused directly to the package firms. An alternative is strip printing of peelable filn without a closure mechanism or separate strip.

The peelable seal 40 provides a hermetic seal at the mouth of the package. The hermetic seal prevents air and water from penetrating the package films. This keeps the contents of the package in a constant environment to prevent spoilage.

Prior to initially opening a package incorporating the closure arrangement shown in FIG. 4, the peelable seal 40 is intact, the closure profiles 28, 30 are interlocked with each other, and the top and bottom films 15, 16 are connected at the mouth end 31 of the bag. The top and bottom films 15, 16 are heat-fused together at the mouth end 31 of the bag shown in FIG. 1. Because the peelable seal 40 already provides a hermetic seal for the package, the top and bottom films 15, 16 may alternatively be disconnected from each other at the mouth end 31.

To open the bag, the top and bottom films 15, 16 are separated from each other by cutting them apart. Next, the interlocked closure profiles 28, 30 are detached from each other by grabbing onto the top and bottom films 15, 16 and pulling them apart. Finally, the peelable seal 40 is broken by continuing to pull the top and bottom films 15, 16 in opposite directions. The strength of the peelable seal 40 is determined by the composition of the peelable material, temperature, pressure, dwell time of the seal bars, and the size of the peelable seal 40. Generally, the peelable seal 40 should have a strength ranging from two to six pounds per linear inch. This strength provides an adequate hermetic seal while still allowing the consumer to "peel" the peelable seal apart.

The above specification and examples are believed to provide a complete description of the manufacture and use of particular embodiments of the invention. Because many embodiments of the invention can be made without departing from the spirit and scope of the invention, the true scope and spirit of the invention reside in the broad meaning of the claims hereinafter appended.

What is claimed is:

1. A closure arrangement for use with a polymeric package having first and second opposing film panels, comprising:

first and second opposing base strips each having an inner and outer surface, the outer surfaces of the first and second opposing base strips being adapted for attachment to the respective first and second film panels of the polymeric package;

a peelable seal including:

a first multi-layered film comprising a first layer for attachment to the first base strip and a third layer being attached to the first layer and having colored ribs;

a second multi-layered film comprising a second layer for attachment to the second base strip and a fourth layer being attached to the second layer and having colored ribs;

the third and fourth layers being fused together creating a hermetic seal, the peelable seal being broken by disengaging the fourth layer of the second multi-layered film from the second layer, and with the fourth layer remaining adhered to the third layer of the first multi-layered film.

2. A closure arrangement for use with a polymeric package according to claim 1, wherein the third and fourth layer are a same color.

3. A closure arrangement for use with a polymeric package according to claim 1, wherein the third and fourth layer are different colors.

4. A closure arrangement for use with a polymeric package according to claim 1, wherein the first and second opposing base strips further have an interlocking closure member on their respective inner surface to provide a resealable closure mechanism.

5. A closure arrangement for use with a polymeric package according to claim 4, wherein the interlocking closure member comprises at least one of a male interlocking closure member and a female interlocking closure member.

6. A closure arrangement for use with a polymeric package according to claim 1, wherein the third and fourth layers fuse to form a single layer providing a hermetic seal and having a single wide band of color.

7. A closure arrangement for use with a polymeric package according to claim 1, wherein the base strips and the peelable seal comprise a polymeric material.

8. A polymeric package comprising:

a plurality of film panels sealed to each other;

a plurality of base strips disposed along and sealed to a side of a respective film panel; and a plurality of peelable seals including:

a first and second layer for attachment to the base strips;

a third layer being attached to the first layer and having colored ribs to indicate whether a hermetic seal has been achieved;

a fourth layer being attached to the second layer and having colored ribs to indicate whether a hermetic seal has been achieved;

the third and fourth layers being fused together creating a hermetic seal, the seal being broken by disengaging the fourth layer from the second layer, with the fourth layer remaining adhered to the third layer.

9. A polymeric package according to claim 8, wherein the third and fourth layer are colored a same color.

10. A polymeric package according to claim 8, wherein the third and fourth layer are different colors.

11. A polymeric package according to claim 8, wherein the base strips further have an interlocking closure member to provide a resealable closure mechanism.

12. A polymeric package according to claim 11, wherein the interlocking closure member comprises at least one of a male interlocking closure member and a female interlocking closure member.

13. A polymeric package according to claim 8, wherein the base strips and the peelable seal comprise a polymeric material.

* * * * *